United States Patent [19]

Okaniwa et al.

[11] 4,390,617

[45] Jun. 28, 1983

[54] METHOD FOR THE FORMATION OF PHOTOGRAPHIC IMAGES

[75] Inventors: Kenichiro Okaniwa; Toyoaki Masukawa; Kiyoshi Yamashita; Wataru Ishikawa, all of Hino, Japan

[73] Assignee: Konishiroku Photo Industry Co., Ltd., Tokyo, Japan

[21] Appl. No.: 240,806

[22] Filed: Mar. 5, 1981

[30] Foreign Application Priority Data

Mar. 18, 1980 [JP] Japan ..... 55-35095

[51] Int. Cl.[3] ..... G03C 5/24

[52] U.S. Cl. ..... 430/350; 430/351; 430/354; 430/376; 430/380; 430/543; 430/566; 430/955

[58] Field of Search ..... 430/350, 351, 353, 354, 430/448, 566, 955, 380, 376, 543

[56] References Cited

U.S. PATENT DOCUMENTS

| | | | |
|---|---|---|---|
| 3,041,170 | 6/1962 | Haist et al. | 430/955 |
| 3,220,846 | 11/1965 | Tinker et al. | 430/350 |
| 3,342,599 | 9/1967 | Reeves | 430/371 |
| 3,468,664 | 9/1969 | Stewart | 430/354 |
| 3,523,795 | 8/1970 | Ohkubo et al. | 430/348 |
| 3,635,719 | 1/1972 | Ohkubo et al. | 430/350 |
| 3,705,035 | 12/1972 | Vetter et al. | 430/380 |
| 3,719,492 | 3/1973 | Barr et al. | 430/376 |
| 3,761,270 | 9/1973 | De Mauriac et al. | 430/351 |
| 3,844,788 | 10/1974 | Burness et al. | 430/352 |

*Primary Examiner*—J. Travis Brown

*Attorney, Agent, or Firm*—Jordan B. Bierman; Linda Bierman

[57] ABSTRACT

The present invention is directed towards a silver halide photographic material which has a reducing agent for silver halide or a precursor thereof and a compound $M_lH_m(PO_n)_i \cdot jH_2O$ which generates base when heat is applied. M is a metal from the Groups IA and IIA of the Periodic Table, 1 and i are individually integers from 1 to 3, m is an integer from 0 to 4, n is 3 or 4, and j is an integer from 0 to 12.

11 Claims, No Drawings

METHOD FOR THE FORMATION OF PHOTOGRAPHIC IMAGES

The present invention relates to a method for the formation of photographic images by use of a silver halide photosensitive material, and more particularly to the improvement for simplifying and speeding the processing in the method for the formation of photographic images using a silver halide photosensitive material containing a reducing agent.

General methods for the formation of photographic images are represented in black-and-white photography by the method wherein a silver image is obtained by developing with a developer an imagewise exposed silver halide photosensitive material, and represented in the color photographic image formation by the method wherein an azomethine dye image or indoaniline dye image is obtained by processing an imagewise exposed silver halide photosensitive material with the use of an aromatic primary amine developing agent in the presence of a coupler capable of forming the dye in the reaction with the oxidation product of said developing agent.

These methods for the photographic image formation have been still lately subjected to various improvements.

The processings of color photosensitive materials are based on the following steps:

(1) Color developing process (2) Bleaching process (3) Fixing process

Of the above processes, both the bleaching and fixing processes may be carried out simultaneously in a single bath, generally known as "blix," in which thus both the developed silver and undeveloped silver halide can be desilvered.

In an actual processing practice, aside from the abovedescribed fundamental processes, there are many cases where auxiliary processes are needed for the purpose of, e.g., stopping the development or stabilizing the resulting photographic image.

In the color developing process for color photosensitive materials, usually, for example, an aromatic primary amine developing agent dissolved in an alkali aqueous solution is used as a color developing liquid. Therefore, in the case where the aromatic primary amine developing agent is incorporated in a similar manner to that of other additives into the component layer of a photosensitive material, the color development thereof can be made basically in a plain alkali aqueous solution only. This not only simplifies the preparation for a developing liquid but results in little change of the composition thereof, thus enabling an easy maintenance of the liquid. Besides, there is such an advantage that the B.O.D. of waste development liquid is extremely lowered, so that the waste water disposal can readily be carried out.

In general, however, the incorporation of an aromatic primary amine developing agent into a photosensitive material is not yet made a practical reality because of its disadvantages that it causes the photosensitive material to be desensitized, to produce fog or stains in course of time, or insufficient color densities obtained by processing.

There have been known some studies made, to cope with this problem, for methods of incorporating aromatic primary amine developing agents into photosensitive materials, such as, for example, U.S. Pat. No. 3,342,599 describing the use of a Schiff's base with salicylaldehyde is a developing agent precursor; U.S. Pat. No. 3,719,492 describing the use of salts of such metals as lead, cadmium, and the like with the agent; British Pat. No. 1,069,061 describing the use of a developing agent precursor of the phthalimide type obtained by the reaction of an aromatic primary amine with phthalic acid; Japanese patent application No. 26756/1977 describing the combined use of an aromatic primary amine with cyclic $\beta$-dicarbonyl compound; Japanese patent application No. 50909/1977 describing the use of a precursor produced by coupling an aromatic primary amine with substituted or unsubstituted (2-benzenesulfonyl)ethoxycarbonyl; and others such as West Germany Pat. Nos. 1,159,758 and 1,200,679, U.S. Pat. No. 3,705,035, and the like.

The use of color developing agent precursors and the like in the above-described patents has come to enable the incorporation of color developing agents in the form of stable compounds into photosensitive materials, so that the rapid development of color photosensitive materials with nothing but alkali aqueous solution (which is called activator hereinafter) has become feasible.

Normally, the pH of the above-described alkali activators is in the range from about 7 to 14, and the temperature of it is from about 20° C. to 70° C.

These alkali activators are basically ones comprising the color developing baths excluding the developing sgents therefrom. As buffer agents for activators there may be used singly or in combination, e.g., sodium hydroxide, potassium hydroxide, sodium carbonate, potassium carbonate, sodium or potassium triphosphate, potassium metaborate, borax, and the like.

Further, sodium hydrogenphosphate, sodium hydrogencarbonate, and the like may be added to the activators for the purpose of providing them with buffering ability or increasing the ionic strength thereof, and other various additives may also be added for the improvement in photographic characteristics.

The use of such alkali activators, as aforementioned, has such advantages as to simplify the developing process of photographic materials as well as to facilitate the retention of the processing liquid itself and the disposal of the resulting waste water. However, the further simplification, further speeding up, and more conformity to eargent needs of the processing of photosensitive materials are now becoming a big issue in developing the wider photographic material application.

Hence it is an object of the present invention to provide a method for the formation of photographic images with further simplified and more rapid development of silver halide photosensitive materials, and more particularly to provide a method for the formation of photographic images which enables to give images of sufficiently high maximum density without having bad effects upon the photographic characteristics such as sensitivity, fog, stains, and the like by the simplified and rapid developing process.

According to the present invention a photographic image is obtained by the heating a silver halide photographic material containing a silver halide reducing agent or a precursor thereof in the presene of a heat-sensitive base generating agent.

As the foregoing heat-sensitive base generating agent there are some examples such as the guanidinium trichloroacetate described in U.S. Pat. No. 3,220,846 and 3,761,270; the metal oxides or metal hydroxides described in U.S. Pat. No. 3,635,719; the aliphatic and aromatic amine oxalates described in U.S. Pat. No. 3,523,795; and the sulfonyl derivatives of isothiourea described in U.S. Pat. No. 3,844,788.

According to the preferred embodiment of the present invention proposes the base generating agents having the formula is employed:

Formula [I]:

$$MlHm(POn)i.jH_2O$$

Wherein M represents lithium, sodium, potassium, rubidium, beryllium, magnesium, calcium and barium, l and i each is an integer of from 1 to 3, m is from 0 to 4, n is an integer of 3 or 4, and j is an integer of from 0 to 12.

The following are examples of the base generating agents applicable to the present invention.

(1) $LiH_2PO_4$
(2) $Li_3PO_4.12H_2O$
(3) $Na_2HPO_4.7H_2O$
(4) $Na_2HPO_4.12H_2O$
(5) $NaH_2PO_4.2H_2O$
(6) $Na_3PO_4.12H_2O$
(7) $Na_2HPO_3.5H_2O$
(8) $K_2HPO_4$
(9) $KH_2PO_4$
(10) $K_3PO_4.8H_2O$
(11) $K_2HPO_3$
(12) $MgHPO_4.7H_2O$
(13) $MgH_4(PO_4)_2.3H_2O$
(14) $Mg_3(PO_4)_2.8H_2O$
(15) $CaHPO_4.2H_2O$
(16) $CaH_4(PO_4)_2.H_2O$
(17) $Ca_3(PO_4)_2$
(18) $CaHPO_3$
(19) $BaHPO_4$
(20) $BaHPO_3$
(21) $Ba_3(PO_4)_2$
(22) $BaH_4(PO_4)_2$
(23) $Be_2(PO_4)_2.3H_2O$
(24) $RbH_2PO_4$.

The compounds having Formula I are excellent photographically in that they effect little or no desensitization and staining, while they effect the increase in the maximum density of photographic images.

Among these compounds usable in the present invention, the preferred ones are mono-, di-, and triphosphates of the metals belonging to the groups 1a and 2a of the periodic table, the M of the foregoing general formula of said compounds being lithium, sodium or magnesium, while the X thereof being 5 or more. To apply these base generating agents to photosensitive materials, these compounds should first be dispersed or dissolved into an organic solvent or aqueous solution containing a binder. The adding concentration in this case should be 50% by weight of less, preferably 10% by weight or less in the emulsion or solution containing a binder.

As such binders there may be used oil-soluble or water-soluble macromolecular compounds such as polystyrene, polyvinyl alcohol, methyl methacrylate, polyvinyl butyral, ethyl cellulose, polyvinyl pyrolidone, gelatin, gelatin derivatives, polyacrylamide, and the like.

In the method for the formation of photographic images in the present invention, a heat-sensitive base generating agent of the present invention is incorporated into any one of the reducing agent-containing component layers of a silver halide photosensitive material or is coated over the said component layer, or is contained in or coated on an independent sheet separate from the photosensitive material, so that the base generating source may be removed from the processing bath. As a result, the means of heat development only, preferably in the presence of water, has succeeded in the formation of good quality images.

Accordingly, in the method for the formation of photographic images of the present invention, earlier-mentioned conventionally known alkali activators may be employed but are not required at all.

The method for the formation of photographic images in the present invention is such that in the case where, for example, the base generating agent is coated to form a layer on a sheet separate from the photosensitive material, the reducing agent-containing silver halide photosensitive material is superposed with the base generating sheet and then heated, preferably with supplying water before and/or heating to develop an image. The supplying amount of water in this case should be 0.2 g or less, preferably 0.1 g or less per 10 $cm^3$ of the area of silver halide emulsion layer. The heating temperature/developing time, when heating after water supply, is from 50° C. to 150° C./up to 90 seconds, but since the material becomes developable when in water heated to the temperature of above room temperature, the heating at 30°–80° C./ 5 seconds to 4 minutes is required for the optimum condition. The water supply may be made in any such manners that the photosensitive material is immersed in a warm water bath, wetted in an appropriate procedure, or sprayed with warm water.

In such an embodiment of the present invention that the heat-sensitive base generating compound is incorporated in a silver halide photographic material, the layer containing the heat-sensitive base generating compound is preferably placed nearer to the support than the silver halide emulsion layer.

The reducing agents applicable to the present invention include various developing agents for silver halides given below:

(1) Substituted phenols such as, for example, p-aminophenol, methyl aminophenol, 2-methoxy-4-aminophenol, p-acetophenol, and the like,
(2) substituted or unsubstituted bisphenols such as, for example, bis(2-hydroxy-3-t-butyl-5-methyl phenyl)methane, bisphenol A, 4,4'-ethylidene-bis-(2-tert-amylphenol), and the like,
(3) substituted or unsubstituted mono- or bisnaphthols and di- or poly-hydroxynaphthalenes such as, e.g., bis(2-hydroxy-1-naphthyl)methane, 2,2'-dihydroxy-1,1'-binaphthyl, β-naphthol, sodium 1-amino-2-naphthol-6-sulfonate, and the like,
(4) di- or polyhydroxybenzenes and hydroxymonoethers such as, e.g., t-butyl hydroquinone, chlorohydroquinone, methoxy hydroquinone, p-methoxyphenol, catechol, pyrogallol, and the like,
(5) monoesters of ascorbic acid and the derivatives thereof such as, e.g., dilaurate of ascrobic acid, and the like,
(6) 3-pyrazolidones and pyrazolones such as, e.g., 1-phenyl-3-pyrazolidone, 4-methyl-4-hydroxymethyl-1-phenyl-3-pyrazolidone, and the like.

(7) reducing sugars such as e.g., glucose, lactose, and the like, and (8) phenylenediamines such as, e.g., N',N'-diethyl-p-phenylene-diamine, N-phenyl-N'-isopropyl-p-phenylenediamine, and the like.

As p-phenylenediamine series developing agents, aside from the above, there have been reported, for example, phenylenediamine series Schiff base described in U.S. Pat. No. 3,342,599, metal salts described in U.S. Pat. No. 3,719,492, phthalimide type compounds described in British Pat. No. 1,069,061, and the like. These reducing agents may be used singly or in combination.

The above-described reducing agents are described to have such a nature as to be capable of forming images in the development for the period of up to 90 seconds within the range of a temperature of from 50° C. to 150° C. The most preferred ones among reducing agents are color developing agents, the most typical examples of which are phenylenediamine series developers. Preferred examples of them are organic acid salts of phenylenediamines having the formula Formula [II]

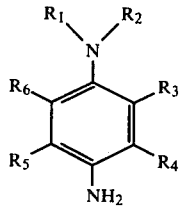

(X)n wherein $R_1$ and $R_2$ each is hydrogen or an alkyl radical having 1–6 carbon atoms, which may have substituents (provided that the $R_1$ and $R_2$ each may be heterocyclic with nitrogen atoms), $R_3$, $R_4$, $R_5$ and $R_6$ each represents hydrogen, halogen, hydroxy, amino, alkoxy, acyl, amide, sulfonamide, alkylsulfonamide, or alkyl having 1–6 carbon atoms (provided that $R_3$ and $R_6$, or $R_3$ or $R_6$ may form a heterocyclic ring with $R_1$ and $R_2$, or $R_1$ or $R_2$), n is an integer of from 1 to 3, and X represents sulfonic acid, sulfinic acid, sulfates, sulfamic acid, thiosulfates S, carboxylic acid, phosphates, phosphonic acid, amidophosphoric acid, phosphites, pyruvic acid, hydroxamic acid, sulfohydroxamic acid, strong acid phenol, dithiocarbamic acid, or organic acid anions of organic boron compounds.

The following are typical examples of phenylenediamines represented by Formula [II] in the present invention:

N,N-diethyl-p-phenylenediamine, 2-amino-5-diethylamino-toluene, 2-amino-5-(N-ethyl-N-propyl-)aminotoluene, 4-[N-ethyl-N-(β-hydroxyethyl-)amino]aniline, 2-methyl-4-[N-ethyl-N-(β-hydroxyethyl)amino]aniline; the N-ethyl-N-(β-methanesulfoamido-ethyl)-3-methyl-4-aminoaniline described in U.S. Pat. No. 2,193,015; the N-(2-amino-5-diethylaminophenyl ethyl) methane-sulfonamide, and N,N-dimethyl-p-phenylenediamine described in U.S. Pat. No. 2,592,364; the 4-amino-3-methyl-N-ethyl-N-methoxyethyl aniline, 4-amino-3-methyl-N-ethyl-N-β-ethoxyethyl aniline and 4-amino-3-methoxy-N-ethyl-N-β-butoxyethyl aniline described in U.S. Pat. Nos. 3,656,950 and 3,698,525.

As examples of organic acids or organic acid salts capable of forming the organic acid salts of color developing agents there may be cited the following compounds:

(A) Sulphonic acids

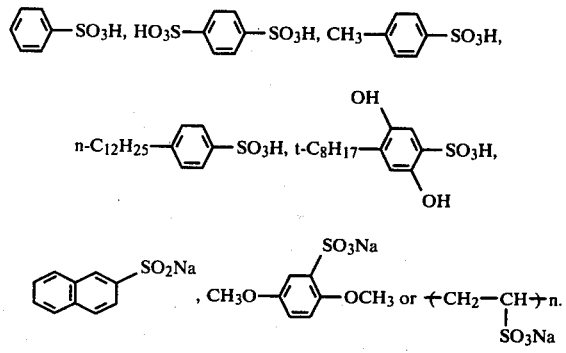

(B) Sulfinic acids

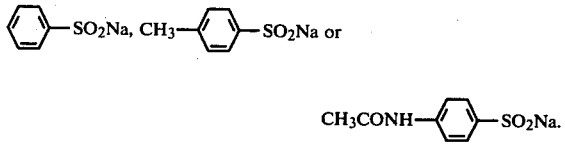

(C) Sulfates

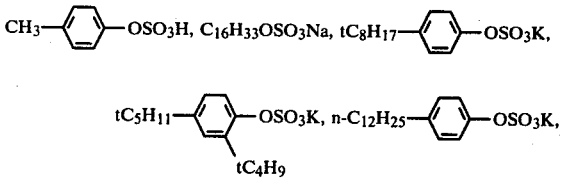

(D) Sulfamic acids

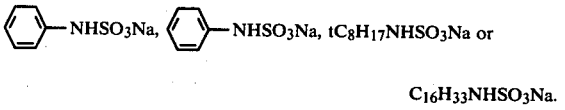

(E) Thiosulfuric acid S—esters

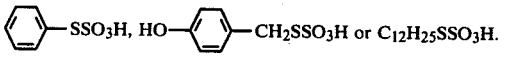

(F) Carboxylic acids

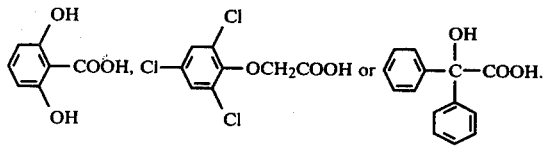

(G) Phosphates

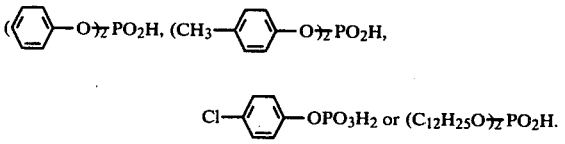

(H) Phosphonic acids

-continued

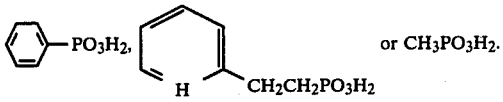

or $CH_3PO_3H_2$.

(I) Amidophosphoric acids

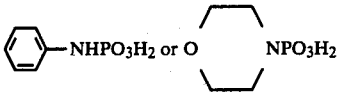

(J) Phosphites

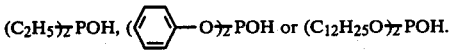

(K) Pyruvic acids

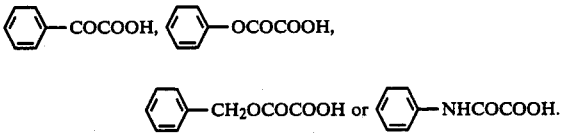

(L) Hydroxamic acids

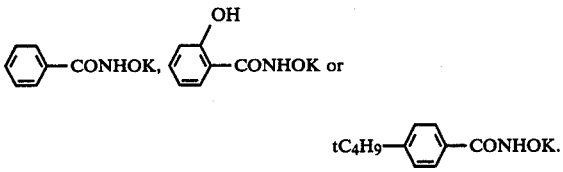

-continued (M) Sulfohydroxamic acids

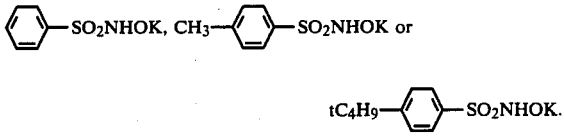

(N) Strong acid phenols

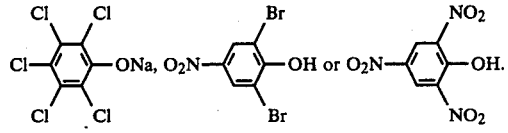

(O) Dithiocarbamic acids

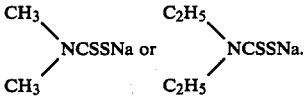

(P) Organic boron compounds

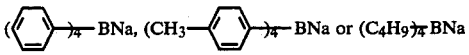

The following are examples of the aromatic primary amine color developing agents protonated in aqueous solvents and the salts produced from organic acid anions, but are not limited thereto:

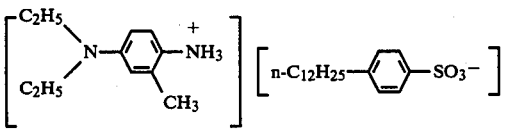

(25)

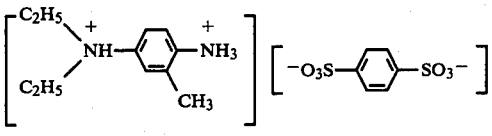

(26)

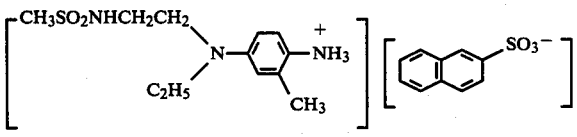

(27)

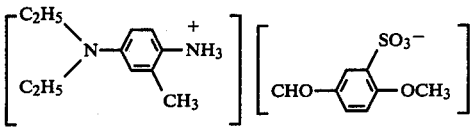

(28)

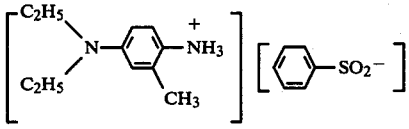

(29)

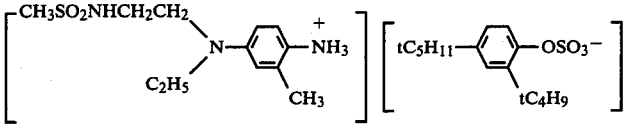

(30)

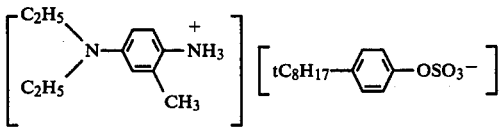

(31)

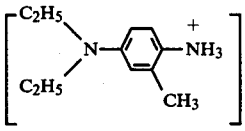

(32)

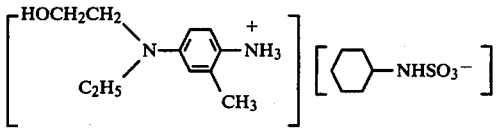

(33)

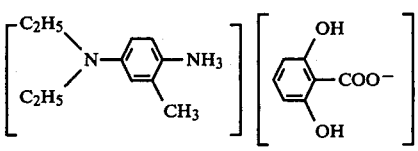

(34)

-continued
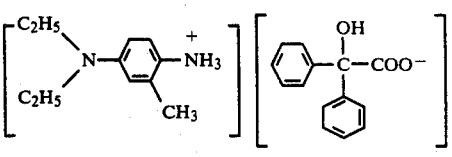
(35)
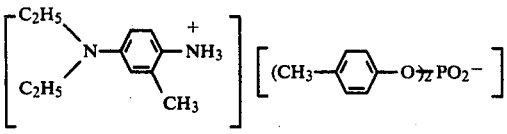
(36)
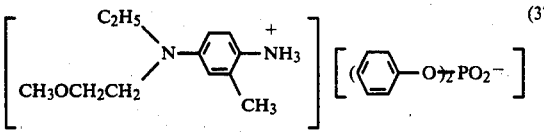
(37)
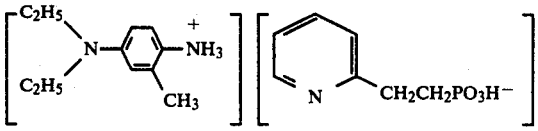
(38)
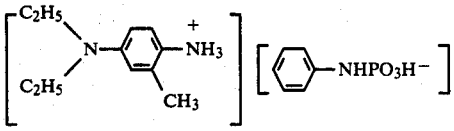
(39)
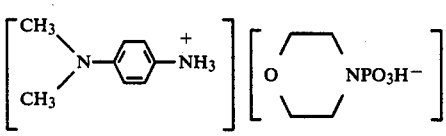
(40)
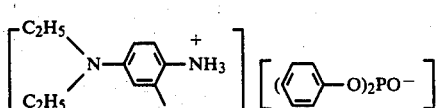
(41)
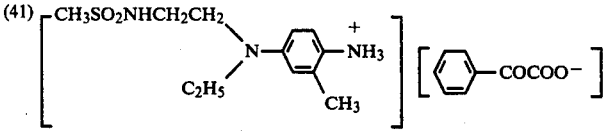
(42)
(43)
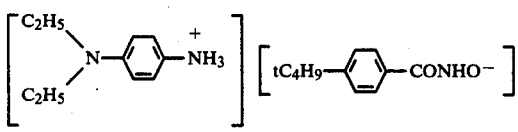
(44)
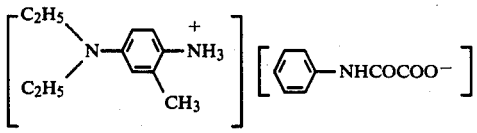
(45)
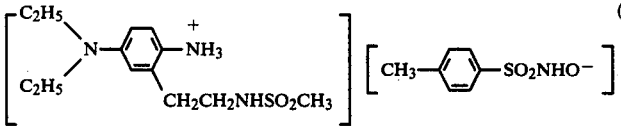
(46)
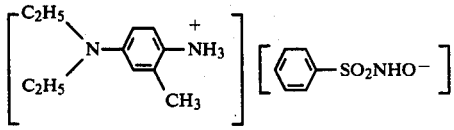
(47)
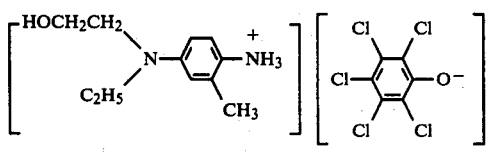
(48)
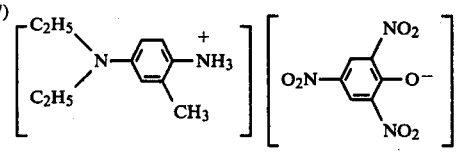
(49)
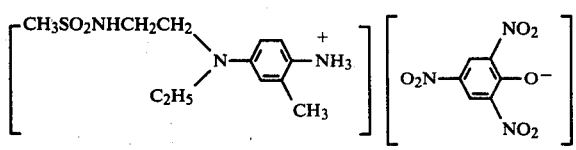
(50)
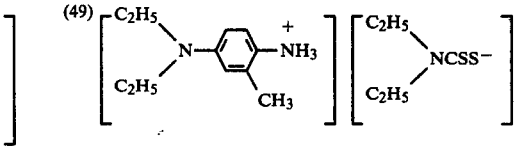
(51)
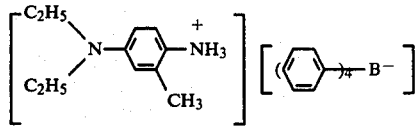
(52)
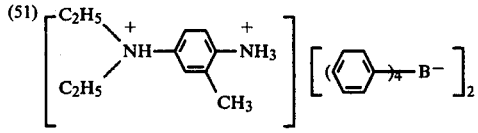
(53)
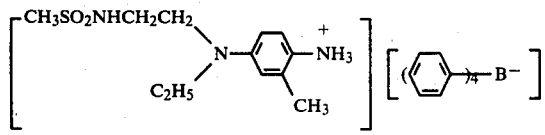
(54)
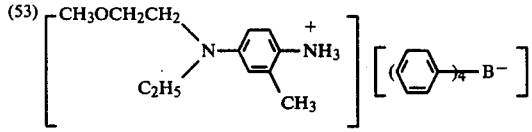

-continued (55)

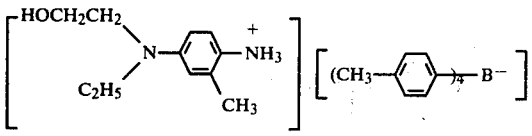

The reducing agent for silver halide to be incorporated in the silver halide photosensitive material used in the present invention may be contained in at least one layer of, e.g., the silver halide emulsion layer, interlayer, protective layer, subbing layer, and the like.

The adding amount of the reducing agent should be from 0.1 to 10 times mol, preferably from 0.25 to 5 times mol to the whole silver quantity in the unit area of the photosensitive material.

In order to incorporate the reducing agent into the abovedescribed component layer, the reducing agent is dissolved in a hydrophilic organic solvent such as methyl alcohol, ethyl alcohol, acetone, and the like, and the resulting solution is then added to a hydrophilic colloidal liquid, i.e., the component layer, to be dispersed therein. Besides, there may also be used other methods such as the method wherein latexes or other polymers are used, the method wherein the compound is dispersed into a hydrophilic colloidal solution by the use of a coupler solvent such as, for example, tri-O-cresylphosphate, dibutylphthalate, and the like. To disperse these oil phases into a water phase, there may be utilized generally known surfactants such as anionic, nonionic, cationic, amphoteric, and the like.

The binders usable in the present invention include oilsoluble macromolecular compounds such as polystyrene, polyvinyl butyral, polyethylene terephthalate, and the like, or gelatin known as a hydrophilic colloid, gelatin derivatives, gelatin craft polymers various cellulose derivatives, partially saponified products of polyvinyl alcohols, sodium alginate, poly-N-vinyl pyrolidone, and the like. To these emulsions may be added known antioxidants or stabilizers for photographic use.

The silver halide of photosensitive materials used in the method for the formation of photographic images of the present invention is prepared in usual manners and may be silver chloride, silver bromide, silver bromoiodide, silver chlorobromide, silver chloroiodide, silver chlorobromoiodide, silver iodide, or the mixture thereof, which may be chemically sensitized in usual manners. These silver halide emulsions may contain conventionally utilized additives such as antifoggants, hardeners, plasticizers, toning agents, surface active agents, and the like.

Further, the support for the layer or layers of the abovedescribed photosensitive material includes polyethylene terephthalate, cellulose acetate butyrate, polycarbonate, polystyrene, metal, glass, paper, and in addition, there may also be useful polyolefin-coated paper and such supports which may be made of various materials including ones well known to those in the art.

The couplers applicable to the above-described photosensitive material include such yellow dye forming couplers as, for example, benzoyl acetanilide type couplers, pivaloyl acetanilide type couplers or two equivalent yellow dye forming couplers substituted by substituents (the so-called split-off radical) wherein the carbon atom in the coupling position is secedable at the time of coupling; such magenta dye forming couplers as, e.g., 5-pyrazolone couplers, pyrazolotriazole couplers, pyrazolinobenzimidazole couplers, indazoline couplers or two equivalent magenta dye forming couplers, among which the 5-pyrazolone couplers are the most useful; and such cyan dye forming couplers as phenol couplers, naphthol couplers, pyrazoloquinazolone couplers or two equivalent cyan dye forming couplers having split-off radicals, among which the phenol or naphthol cyan dye forming couplers are the most useful.

Of these dye forming couplers, the yellow couplers are described in U.S. Pat. Nos. 3,265,506, 3,875,057, 3,408,928, 3,277,155, 3,415,652 and 3,664,841, Japanese Patent Publication Open to Public Inspection (hereinafter referred to as Japanese Patent O.P.I. Publication) Nos. 29432/1973 and 66834/1973, Japanese patent examined publication No. 13576/1974, Japanese patent O.P.I. publication Nos. 28834/1975, 10736/1974, 132926/1975 and 122335/1974; the magenta couplers are described in U.S. Pat. Nos. 2,600,788, 3,062,653, 3,127,269, 2,311,476, 3,419,391, 3,519,429, 3,558,319, 3,684,514 and 3,888,680, Japanese patent O.P.I. publication Nos. 29639/1974 and 111631/1974; and the cyan couplers are described in U.S. Pat. Nos. 2,423,730, 2,474,293, 2,801,171, 2,895,826, 3,476,563, 3,737,316, 3,758,308 and 3,839,044, Japanese patent O.P.I. publication Nos. 37425/1972, 10135/1975, 25228/1975, 112038/1975, 117422/1975 and 130441/1975, and besides, the black dye forming couplers are described in West German OLS Pat. No. 2,644,194.

The present invention is illustrated in further detail with reference to examples below.

EXAMPLE 1

Two grams of exemplified compound (6) of the present invention as a base generating agent were added to 50 ml. of ethanol, and dispersed by a ball mill spending a period of 48 hours, and to the mixture were added 50 ml. of a 10% polyvinyl butyral to be further dispersed by the ball mill spending a period of 3 hours. The resulting dispersed liquid was coated over a resin-coated paper support, which resulting product was regarded as base generating agent layer A.

A solution of two grams of exemplified compound (6) dissolved in 50 ml. of water was added dropwise to 50 ml. of a 10% aqueous gelating solution. To the resulting solution were added a coating aid and hardener, and the resulting mixture was similarly coated over a resin-coated paper support. The thus obtained sample was regarded as base generating agent layer B.

3.3 g of a color developing agent, the exemplified compound (25) were added to a mixture of 3 ml. of dibutylphthalate with 20 ml. of ethyl acetate and dissolved completely at 40° C. The resulting solution was mixed with 5 ml. of a 10% aqueous Alkanol B (alkyl naphthalenesulfate, manufactured by DuPont) solution and 200 ml. of a 5% aqueous gelatin solution and dispersed to be emulsified by means of a colloid mill, thus preparing a dispersed liquid of the color developing agent, to which were further added water, a coating aid and a hardener to make the whole 330 ml. The thus produced liquid was coated over the foregoing base generating agent layer A. The coating amount per 100 $cm^2$ of the color developing agent was 3.0 mg.

On this layer was further coated and dried a mixture of a red-sensitive silver chlorobromide emulsion with a aqueous gelatin solution into which was protectively dispersed a dibutyl phthalate solution of 2-[2-(2,4-di-t-bentylphenoxy)butaneamide]-4,6-dichloro-5-methyl phenol as a coupler. The coating amount per 100 $cm^2$ of the coupelr was 3.0 mg. and that of silver was 2.1 mg.

The thus obtained sample was regarded as sample 1. Another sample that was obtained in quite the same manner as in sample 1 with the exception that exemplified compound (29) was used as a color developing agent in place of the exemplified compound (25) was regarded as sample 2. Likewise, still another sample obtained by the use of exemplified compound (32) was regarded as sample 3.

Subsequently, a sample obtained in quite the same manner as in sample 1 by the use of base generating agent layer B in place of the base generating agnet A was regarded as sample 4. Likewise, samples obtained in the same manner as in sample 2 and sample 3 by the use of base generating agent layer B were regarded as sample 5 and sample 6 respectively.

Each of the above-described samples 1-6 was exposed through a step-wedge to white light, was immersed for three seconds in water, and then was heated for 20 seconds at 80° C. from the back of the paper support or was put through for two seconds between a pair of rollers heated at 130° C., whereupon the respective samples were treated in the following processing baths to yield finished images. Meanwhile, control samples were heat-treated in an identical manner as well without being immersed in water.

The processings:

| | | |
|---|---|---|
| Bleach-fixing | at 38° C. | for 1 minute 30 seconds |
| Washing | at 38° C. | for 2 minutes |

The composition of the bleach-fixing bath is:

| | |
|---|---|
| Ammonium thiosulfate (70%) | 150 ml. |
| Sodium sulfite | 5 g. |
| Na(Fe(II) (EDTA) | 40 g. |
| EDTA | 4 g. |
| Water to make 1 liter | |
| (EDTA stands for ethylenediamine tetraacetic acid) | |

The results are shown in Table 1.

TABLE 1

| Sample No. | Exemplified compound No. | Binder | Heating Time (sec.) | Heating Temperature (°C.) | Photographic image characteristics Fog | Relative speed | Maximum density |
|---|---|---|---|---|---|---|---|
| 1 | (6) (25) | PVB* | | | 0.11 | 100 | 2.11 |
| 2 | (6) (29) | PVB | | | 0.12 | 98 | 2.11 |
| 3 | (6) (32) | PVB | | | 0.11 | 97 | 2.10 |
| 4 | (6) (25) | Gelatin | 20 | 80 | 0.12 | 114 | 2.40 |
| 5 | (6) (29) | Gelatin | | | 0.13 | 112 | 2.39 |
| 6 | (6) (32) | Gelatin | | | 0.12 | 110 | 2.41 |
| Control | (6) (25) | Gelatin | | | 0.11 | 54 | 0.74 |
| 1 | (6) (25) | PVB | | | 0.12 | 100 | 2.23 |
| 2 | (6) (29) | PVB | | | 0.13 | 100 | 2.21 |
| 3 | (6) (32) | PVB | | | 0.13 | 101 | 2.25 |
| 4 | (6) (25) | Gelatin | 2 | 130 | 0.09 | 124 | 2.45 |
| 5 | (6) (29) | Gelatin | | | 0.10 | 120 | 2.41 |
| 6 | (6) (32) | Gelatin | | | 0.10 | 122 | 2.47 |

TABLE 1-continued

| Sample No. | Exemplified compound No. | Binder | Heating Time (sec.) | Heating Temperature (°C.) | Photographic image characteristics Fog | Relative speed | Maximum density |
|---|---|---|---|---|---|---|---|
| Control | (6) (25) | Gelatin | | | 0.13 | 56 | 0.81 |

*Polyvinylbutyral

The relative speeds shown in the above table are the values relative to the speed of sample 1 regarded as 100.

As apparent from the table the control sample which was heat-developed without supplying water shows lower speed with lower maximum density, whereas the samples 1-6 prepared in accordance with the method of the present invention each has small fog even in the short time heat development and is excellent in both the speed and color density.

EXAMPLE 2

Each of the samples 5 and 6 used in Example 1 was exposed through the step wedge to a white light and thereafter cut into three pieces, which were then immersed in water at 55° C. for 10 seconds, 60 seconds and 120 seconds respectively, and subsequently treated in the bleach-fixing bath shown in Example 1 and then washed, thereby yielding images. The results are shown in Table 2.

TABLE 2

| Sample No. | Heating temperature | Heating period | Fog | Maximum density |
|---|---|---|---|---|
| 5 | | 10 | 0.09 | 2.29 |
| 5 | | 60 | 0.11 | 2.41 |
| 5 | 55° C. | 120 | 0.12 | 2.43 |
| 6 | | 10 | 0.10 | 2.31 |
| 6 | | 60 | 0.10 | 2.42 |
| 6 | | 120 | 0.13 | 2.49 |

From table 2 it is understood that the color images of sufficient maximum densities with small fog can be formed in a plain warm water bath only even for a period as short as 10 seconds.

EXAMPLE 3

A sample was prepared in quite the same manner with the use of exemplified compound (2) as a base generating agent in place of the exemplified compound (6) used in sample 4 in Example 1 was regarded as sample 7, a sample similarly prepared with the use of exemplified compound (4) as a base generating agent was regarded as sample 8, and likewise a sample obtained by the use of exemplified compound (7) was regarded as sample 9. The thus prepared samples 7, 8 and 9 were treated in the same manner as in Example 1 to produce color images. In addition the same samples which were heated without supplying water were regarded as controls. The obtained results are shown in Table 3.

TABLE 3

| Sample No. | Exemplified compound No. | Heating period (sec.) | Temperature (°C.) | Fog | Maximum density |
|---|---|---|---|---|---|
| 7 | (2) (25) | 20 | 80 | 0.12 | 2.40 |
| 8 | (4) (25) | 20 | 80 | 0.09 | 2.42 |
| 9 | (7) (25) | 20 | 80 | 0.10 | 2.44 |
| 7 | (2) (25) | 2 | 130 | 0.10 | 2.45 |
| 8 | (4) (25) | 2 | 130 | 0.08 | 2.46 |

TABLE 3-continued

| Sample No. | Exemplified compound No. | Heating period (sec.) | Temperature (°C.) | Fog | Maximum density |
|---|---|---|---|---|---|
| 9 | (7) (25) | 2 | 130 | 0.10 | 2.43 |
| Control | (2) (25) | 2 | 130 | 0.09 | 0.81 |
| Control | (4) (25) | 2 | 130 | 0.09 | 0.81 |
| Control | (7) (25) | 2 | 130 | 0.09 | 0.82 |

As apparent from table 3 the samples containing the base generating agents of the present invention which were heat-developed supplying water are found out to be capable of forming images excellent in the color-developed density as compared to the controls which were heated without supplying water.

EXAMPLE 4

Sample 10 was prepared in such a procedure that a coating containing a color developing agent precursor represented by exemplified compound (51) of the present invention was made in the same manner as in Example 1 over the base generating layer (B) described in Example 1, which was then further coated thereon with an emulsion containing the coupler in a similar manner to the foregoing example.

The resulting sample was exposed through the step wedge to a white light and thereafter was cut into pieces which were immersed in a plain water bath and different compositions-containing water baths for three seconds respectively, and then heated for 20 seconds to 80° C. over a heat block, whereupon these pieces were treated in the same manner as in Example 1 to produce color images.

The obtained results are shown in table 4. The sample heat-developed without supplying water was regarded as control.

TABLE 4

| | Fog | Max. density |
|---|---|---|
| Water | 0.15 | 2.43 |
| 0.1% aqueous KBr solution | 0.08 | 2.29 |
| 2% benzyl alcohol solution | 0.21 | 2.51 |
| 1% aqueous sodium sulfite solution | 0.09 | 2.31 |
| Activator solution | 0.08 | 2.52 |
| Control (no water supplied) | 0.08 | 0.83 |

The composition of the activator in the above table is as follows:

| | |
|---|---|
| Benzyl alcohol | 17.0 g |
| Ethylene glycol | 14.1 g |
| Hydroxylamine chloride | 3.9 g |
| $K_2SO_3$ | 2.2 g |
| KCl | 0.5 g |
| KBr | 0.6 g |
| Tetrapolyphosphoric acid | 1.2 g |
| Whitex BB (brightening agent, manufactured by Sumitomo Chemical Co., Ltd.) | 0.8 g |
| Water to make 1 liter, whose pH is controlled 7.0 | |

As apparent from table 4, it is found out that just as in the case of the heat development in the presence of water only, color images of little fog with high density can be obtained even by the use of an activator with the composition excluding alkali contents and a color developing agent from an ordinary color developing bath prescription.

EXAMPLE 5

A resin-coated paper support was coated thereon with a liquid prepared by adding a solution of 5 g. of a base generating agent represented by exemplified compound (6) of the present invention dissolved into 50 ml. of water and further a coating aid and hardener to 50 ml. of a 10% aqueous gelatin solution.

On the thus coated sample there was further coated an emulsion mixture prepared in such a procedure that a solution of a coupler, 2-(1-benzyl-2,4-dioxyimidazolidine-3-yl)-2-pivalyl-2'-chloro-5'-[4-(2,4-di-t-pentylphenoxy)butaneamide]acetanilide dissolved into dibutyl phthalate was protect-dispersed into an aqueous gelatin solution, which was then mixed with a silver chlorobromide emulsion. The coated amounts per 100 $cm^2$ of the coupler and silver used in above were 8.3 mg. and 3.5 mg. respectively.

The above product was further coated thereon with a liquid produced in such a manner that a solution of dioctyl hydroquinone and exemplified compound (51) dissolved into tricresyl-phosphate was protect-dispersed into an aqueous gelatin solution. The coated amounts per 100 $cm^2$ of the dioctyl hydroquinone and exemplified compound (51) were 0.9 mg. and 5.9 mg. respectively.

This was still further coated thereon with an emulsion mixture produced in such a procedure that a solution of a coupler, 3-{2-chloro-5-[1-(octadecyl)succineimide]anilino}-1-(2,4,6-trichlorophenyl)-5-pyrazolone dissolved in dibutyl phthalate was protect-dispersed in an aqueous gelatin solution, which was then mixed with a green-sensitive silver chlorobromide emulsion. The coated amounts per 100 $cm^2$ of the coupler and silver used were 4.3 mg. and 3.9 mg. respectively.

On the thus coated layer was again coated a dispersed liquid prepared in such a procedure that a solution of dioctyl hydroquinone and exemplified compound (51) dissolved into tricresyl phosphate was protect-dispersed into an aqueous gelatin solution. The coated amounts per 100 $cm^2$ of the octyl hydroquinone and exemplified compound (51) used were 0.5 mg. and 4.7 mg. respectively.

Further on this layer there was coated and dried an emulsion mixture produced in such a manner that a solution of a coupler, 2-[2-(2,4-di-t-benzyl phenoxy)-butaneamide]-4,6-dichloro-5-methyl phenol dissolved into dibutyl phthalate was protect-dispersed into an aqueous gelatin solution, which was then mixed with a red-sensitive silver chlorobromide emulsion. The coated amounts per 100 $cm^2$ of the coupler and silver used were 3.0 mg. and 2.1 mg. respectively.

This layer was then provided thereon with a coating of a liquid obtained in such a procedure that a solution of exemplified (51) dissolved into tricresyl phosphate was protect-dispersed into an aqueous gelatin solution. The coated amount per 100 $cm^2$ of the compound was 2.6 mg.

The thus yielded sample was regarded as sample 11, which was cut into strips which were exposed through the step wedge to blue, green and red lights respectively and thereafter immersed into water at 20° C. for three seconds, whereupon these strips were heated for 70 seconds to 80° C. over a heating block, and then treated in the same manner as in Example 1. The obtained results are shown in table 5.

TABLE 5

| Sample | Fog | | | Relative speed | | | Maximum density | | |
|---|---|---|---|---|---|---|---|---|---|
| No. | Y | M | C | Y | M | C | Y | M | C |
| 11 | 0.12 | 0.10 | 0.09 | 100 | 102 | 103 | 2.31 | 2.32 | 2.30 |
| Control | 0.25 | 0.35 | 0.21 | 21 | 13 | 43 | 0.54 | 0.79 | 0.90 |

The relative speeds shown in the table are the values relative to the yellow speed of sample 11 regarded as 100. From table 5, sample 11 of the present invention is found out to be superior in the fog, speed and maximum density to the control which was heat-developed without supplying water.

EXAMPLE 6

A polyethylene-coated paper was coated thereof with the following layers in the order described below from the paper support to prepare a silver halide color photographic light-sensitive material. The first layer:

A blue-sensitive silver halide emulsion layer comprising silver chlorobromide emulsion containing 10 mol% silver chloride: The emulsion contains gelatin in the amount of 400 g. per mol of silver halide and is sensitized by a sensitizing dye having the formula

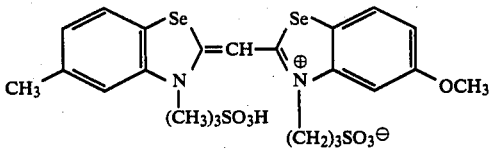

in the amount of $2.5\times10^{-4}$ mol per mol of the silver halide and also contains an yellow coupler, a(1-benyzyl-2,4-dioxoimidazolidine-3-yl)-a-pivaloyl-5-[γ'-(2,4-di-t-benzyl phenoxy)butylamide]-2-chloroacetanilide in the amount of $2\times10^{-1}$ mol per mol of the silver halide, which is dissolved to be dispersed in dioctyl phthalate, which emulsion is to be coated so that the silver quantity be 400 mg./m$^2$. The second layer:

A gelatin layer to be coated so that the dried thickness thereof be 1μ.

The third layer:

A green-sensitive silver halide emulsion layer comprising silver chloride emulsion with 40 mol% silver chloride, which emulsion contains gelatin in the amount of 500 g. per mol of the silver, halide, which is sensitized by a sensitizing dye having the formula

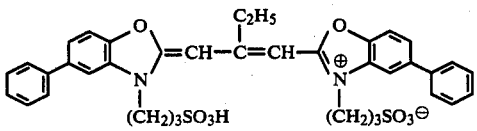

in the amount of $2.5\times10^{-4}$ mol per mol of the silver halide, and also contains a magenta coupler, [1-(2,4,6-trichlorophenyl)-3-{(2-chloro-5-octadesenyl succineimide)anilino}-5-pyrazolone] dissolved and dispersed into tricresyl phosphate and dioctyl phthalate in the amount of $2\times10^{-1}$ mol per mol of the silver halide, and 1,4-di-n-octyloxy-2,5-di-t-butyl benzene in the amount of 30 mol% per mol of the coupler. The resulting emulsion is coated so as to be in the amount of silver of 500 mg./m$^2$.

The fourth layer:

A gelatin layer with the thickness of 1μ having gelatin dissolved in dioctyl phthalate and containing 30 mg./m$^2$ of di-octyl hydroquinone and 0.7 mg./m$^2$ of 2-(2'-hydroxy-3'-secbutyl-5'-t-butyl phenyl)benzotriazole.

The fifth layer:

A red-sensitive silver halide emulsion layer comprising a chlorobromide emulsion containing 20 mol% silver chloride and also containing gelatin in the amount of 500 g. per mol of the silver halide, which emulsion is sensitized by a sensitizing dye having the formula

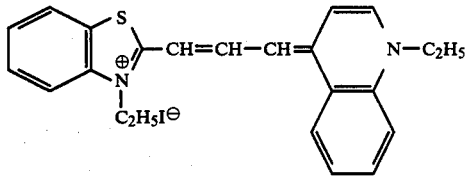

in the amount of $2.5\times10^{-4}$ mol per mol of the silver halide and contains the cyan coupler (c-3) dissolved and dispersed into dibutyl phthalate in the amount of $2\times10^{-1}$ mol per mol of the silver halide. The resulting emulsion is coated so that the amount of silver be 500 mg./m$^2$.

The sixth layer:

A protective layer (a gelatin layer) to be coated so that the dried thickness thereof be 1μ. The silver halide emulsions used in the respective photosensitive layers (the first, second and fifth layers) are prepared in the procedures described in Japanese Patent Examined Publication No. 7772/1971, which emulsions each is chemically sensitized by the use of sodium thiosulfate, penta-hydrated, into which were then incorporated 4-hydroxy-6-methyl-1,3,3a,7-tetrazaindene as a stablizer, bis (vinyl sulfonyl methyl)ether as a hardener, and saponin as a coating aid. The thus prepared samples were exposed through a step wedge to blue, green and red lights respectively.

Aside from the above photosensitive materials, a subbed polyethylene tetraphthalate film support was provided thereon with the following layers in the described order from the support side.

The first layer:

A liquid produced by adding a solution of exemplified compound (6) dissolved into 50 ml. of water to 50 ml. of a 10% aqueous gelatin solution is coated on the film support.

The second layer:

A solution of exemplified compound (35) dissolved in tricresyl phosphate is protect-dispersed into an aqueous gelatin solution. The resulting liquid is coated so that the exemplified compound (35) is in the coating amount of 13 mg. per 100 cm$^2$.

Subsequently, a sample was prepared, aside from the above, with the first layer containing exemplified compound (7) in place of exemplified compound (6), which was regarded as sample 13. And another sample was prepared having the first layer excluding exemplified compound (6) alone, which was regarded as control.

The foregoing exposed photosensitive materials were superposed with samples 15, 16 and 17 respectively with their supports' surface facing outward with water in therebetween, whereupon the superposed samples were heated to 80° C. for 70 seconds over a heating block, and after that each pair was peeled apart, and the photosensitive materials alone were treated in the same manner as in Example 1. The obtained results are shown in Table 6.

TABLE 6

| Sample | Fog | | | Relative speed | | | Maximum density | | |
|---|---|---|---|---|---|---|---|---|---|
| No. | Y | M | C | Y | M | C | Y | M | C |
| 12 | 0.12 | 0.11 | 0.10 | 100 | 101 | 101 | 2.09 | 2.13 | 2.28 |
| 13 | 0.12 | 0.12 | 0.11 | 98 | 101 | 100 | 2.08 | 2.19 | 2.24 |
| Control | — | — | — | — | — | — | — | — | — |

The relative speeds in the above table show the values relative to the yellow speed of sample 12 regarded as 100. The measurements on the control was unable to be effected because there appeared little or no image on it.

As shown in Table 6, such manner that the base generating agent with color developing agent of the present invention constituted separately from the silver halide photosensitive material, and the former is superposed with the latter right before heat development is found out to provide a good result indicating no harm to the photographic characteristics. In the above described experiments, it was found that in the absence of the base generating agent any development cannot be effected even if the color developing agent is present.

What is claimed is:

1. A method for forming a photographic image comprising imagewise exposing a silver halide photographic material which has at least one hydrophilic layer containing a reducing agent for silver halide or a precursor thereof coated on a support, and heating the exposed silver halide photographic material in the presence of a compound that generates base upon the application of heat and represented by the formula $M_lH_m(PO_n)_i \cdot jH_2O$ wherein M is Li, Na, K, Rb, Be, Mg, Ca, or Ba, l and i individually are integers from 1 to 3, m is an integer from 0 to 4, n is 3 or 4 and j is an integer from 0 to 12.

2. The method of claim 1 wherein said photographic material further comprises said compound.

3. A method according to claim 1 wherein a sheet that comprises a support and a hydrophilic layer containing the compound is superposed before the heating.

4. A method according to claim 1 wherein the method further comprises supplying water to the photographic material on or before the heating.

5. A method according to claim 1 wherein temperature of the heating is from 30° to 150° C.

6. A photographic material having a silver halide emulsion layer coated on a support wherein said photographic material comprises a reducing agent, a silver halide or a precursor thereof, and a compound of the formula $M_lH_m(PO_n)_i \cdot jH_2O$, wherein M is Li, Na, K, Rb, Be, Mg, Ca, or Ba, l and i individually are integers from 1 to 3, m is an integer of from 0 to 4, n is 3 or 4, and j is an integer from 0 to 12.

7. A photographic material according to claim 6 wherein M in the formula is Li, Na or Mg.

8. A photographic material according to claim 6 wherein j is an integer of from 5 to 12.

9. A photographic material according to claim 6 wherein the reducing agent is a developing agent.

10. A photographic material according to claim 9 wherein the reducing agent is a color developing agent.

11. A photographic material according to claim 10 wherein said photographic material further comprises a dye forming coupler.

* * * * *